US010000257B2

(12) United States Patent
Brigham, III et al.

(10) Patent No.: US 10,000,257 B2
(45) Date of Patent: Jun. 19, 2018

(54) WATERCRAFT

(71) Applicant: BrighamFloats, LLC, Baltimore, MD (US)

(72) Inventors: Henry Day Brigham, III, Baltimore, MD (US); Carter Michel Brigham, Baltimore, MD (US); Inna Alesina, Owings Mills, MD (US)

(73) Assignee: BRIGHAMFLOATS, LLC, Baltimore, MD (US)

( * ) Notice: Subject to any disclaimer, the term of this patent is extended or adjusted under 35 U.S.C. 154(b) by 0 days. days.

(21) Appl. No.: 15/492,522

(22) Filed: Apr. 20, 2017

(65) Prior Publication Data

US 2017/0225745 A1 Aug. 10, 2017

Related U.S. Application Data

(63) Continuation of application No. 15/019,745, filed on Feb. 9, 2016, now Pat. No. 9,656,725.

(51) Int. Cl.

| | |
|---|---|
| ***B63B 1/04*** | (2006.01) |
| ***B63B 7/08*** | (2006.01) |
| ***B63B 3/48*** | (2006.01) |
| ***B63B 35/73*** | (2006.01) |
| ***B63B 43/04*** | (2006.01) |

(52) U.S. Cl.

CPC ..... *B63B 1/041* (2013.01); *B63B 3/48* (2013.01); *B63B 7/082* (2013.01); *B63B 7/085* (2013.01); *B63B 35/73* (2013.01); *B63B 43/04* (2013.01); *B63B 2207/02* (2013.01)

(58) Field of Classification Search

CPC ..... B63B 1/041

USPC ..... 441/131

See application file for complete search history.

(56) References Cited

U.S. PATENT DOCUMENTS

| | | | | |
|---|---|---|---|---|
| 1,623,284 A | | 4/1927 | Stoddart | |
| 3,092,854 A | * | 6/1963 | Manhart | B63C 9/02 441/38 |
| 3,581,328 A | * | 6/1971 | Smith | B63B 35/81 280/18.1 |
| 3,824,735 A | | 7/1974 | Brandstatter | |
| 3,871,042 A | * | 3/1975 | Farmer | B63B 7/08 114/346 |
| 4,409,921 A | * | 10/1983 | Carroll | B63B 35/38 114/264 |

(Continued)

OTHER PUBLICATIONS

Bellyak 2014 Catalog available from www.bellyak.com (16 pages).

(Continued)

*Primary Examiner* — Lars A Olson
*Assistant Examiner* — Jovon Hayes
(74) *Attorney, Agent, or Firm* — Miles & Stockbridge P.C.

(57) ABSTRACT

A watercraft with a rigid outer hull having a substantially circular shape in plan view and a rounded bottom surface for contacting a body of liquid, and a rigid top surface disposed opposite said bottom surface and integrally formed with the outer hull, the top surface having an annular stability portion with convex walls in cross-section and a recessed flat-bottomed deck portion adapted to receive a person, and an edge of the recessed deck portion being disposed inwardly from an outermost edge of the top portion by a distance, and a method for using same.

20 Claims, 8 Drawing Sheets

(56) References Cited

U.S. PATENT DOCUMENTS 4,576,375 A * 3/1986 Roberts ..... A63B 5/11 472/129
4,603,870 A * 8/1986 Monreal ..... B62B 17/068 280/18
4,696,251 A * 9/1987 Spieldiener ..... B63B 1/041 114/345
D292,695 S 11/1987 Marten
4,750,894 A * 6/1988 Nealey ..... B63C 9/04 114/345
4,850,914 A 7/1989 Cox
4,976,642 A 12/1990 Wilkie
D329,886 S 9/1992 Fujitani
5,231,951 A * 8/1993 Tagar ..... B63B 35/76 114/345
5,433,637 A * 7/1995 Graves ..... A63H 33/18 441/80
5,603,645 A 2/1997 Saccomanno
5,713,293 A 2/1998 Shiffler et al.
5,791,957 A 8/1998 De La Cierva
5,797,779 A 8/1998 Stewart
5,846,108 A 12/1998 Milford
5,860,383 A 1/1999 Whitener
6,220,908 B1 * 4/2001 Peterson ..... B63B 35/76 114/345
6,331,128 B1 12/2001 Schmick
6,468,127 B1 10/2002 Lee
6,554,674 B1 4/2003 Thorne
D478,944 S 8/2003 Peterson
D481,077 S 10/2003 Sirotic
D481,655 S 11/2003 McKee
6,746,291 B1 * 6/2004 Coleman ..... B63B 35/74 280/18.1
D509,784 S 9/2005 Chase
7,074,098 B1 7/2006 Acosta
7,507,132 B2 3/2009 Grune
7,722,506 B2 * 5/2010 Pratson ..... A63B 21/068 273/458
7,753,576 B2 7/2010 Marcinkewicz et al.
D631,524 S 1/2011 Slowinski
7,918,698 B2 * 4/2011 Schloegel ..... B63C 9/04 441/35
7,927,163 B2 * 4/2011 Zeyger ..... B63B 35/73 441/129
D646,738 S 10/2011 Checkley
8,047,886 B1 * 11/2011 McLarty ..... B63B 7/06 114/346
8,187,047 B1 * 5/2012 Brooks ..... B63B 35/76 114/345
D663,251 S 7/2012 Masters
8,246,405 B2 8/2012 Checkley
D694,340 S 11/2013 Laporte
8,696,395 B2 4/2014 Masters
8,696,396 B1 * 4/2014 Churchill ..... B63B 35/811 114/253
8,720,357 B2 * 5/2014 Nemeth ..... B63B 1/041 114/144 R
8,789,487 B2 * 7/2014 Lizzio ..... B63B 35/731 114/346
2005/0148433 A1 * 7/2005 Wang ..... A63B 5/11 482/27
2006/0014449 A1 1/2006 French

OTHER PUBLICATIONS

Hornell, "The Ironbridge Type", British Coracles and Irish Curraghs, 1938 (1 page).
Office Action dated Dec. 30, 2016 for related Design U.S. Appl. No. 29/554,212.
Notice of Allowance dated Jan. 18, 2017 for related U.S. Appl. No. 15/019,745.

* cited by examiner 10
20
30
55
d5
25
50
d2
d3
d4
35
C
A
A'
110
d1
80

WATERCRAFT

FIELD OF THE INVENTION

Embodiments relate generally to a watercraft and methods relating thereto.

BACKGROUND OF THE INVENTION

Personal watercraft have long been useful for providing users with the means to float in and/or traverse a body of water or a watercourse, thereby allowing users to pursue a variety of recreational and commercial activities. Examples of such activities include surfing, boating, kayaking, and, increasingly, paddleboarding. However, existing surfboards, boats, kayaks, and the like are generally designed for linear travel in a forward direction to which a front (or prow or bow) of the craft points. Such existing craft can be difficult or awkward to turn or rotate when deployed in a body of water, thus limiting their usefulness for certain tasks and activities. Furthermore, board-shaped craft and kayaks are notoriously prone to flipping, slipping, and dumping their users or occupants into the water. Non-rigid inflatable flotation tube type toys and craft can also be unstable, thus also likely to lead to the user's being unexpectedly immersed into the water.

Thus, it would be advantageous to provide a safer, stable watercraft designed for ease of rotational movement in the water.

SUMMARY

Embodiments can comprise a watercraft including a rigid outer hull having a substantially circular shape in plan view and a rounded bottom surface for contacting a body of liquid, and a rigid top surface disposed opposite the bottom surface and integrally formed with the outer hull. The top surface comprises an annular stability portion having convex walls in cross-section and a recessed flat-bottomed deck portion adapted to receive a person, and an edge of the recessed deck portion is disposed inwardly from an outermost edge of the top portion by a distance equal to at least one-fourth of a radial distance from the outermost edge to a center of the top surface in plan view.

The watercraft according to various embodiments can also include, in the recessed deck portion, a plurality of arcuately-shaped concavities disposed in a side wall of the recessed deck portion and constructed to contour a knee of a person so as to allow for use of the watercraft with the person's knees each in abutment with an interior surface of one of the arcuately-shaped concavities in a seated or kneeling position, or with the person's feet each in abutment with the interior surface of one of the arcuately-shaped concavities. In at least one embodiment, the plurality of arcuately-shaped concavities can comprise four concavities arranged to form a clover shape in plan view.

The outer hull can further comprise a plurality of scalloped handle portions disposed on opposite sides of the outer hull, and a perimeter rib disposed annularly surrounding a lower portion of the outer hull and having a concave shape in cross-section view. The perimeter rib is constructed such that the perimeter rib of a first one of the watercraft cooperates to fittingly engage corresponding portions of a second one of the watercraft upon which the first watercraft is stacked to provide for stable transportation of a plurality of watercraft.

The watercraft can further include one or more sealable vents for venting air contained within an interior cavity portion formed by the outer hull and the top surface. The sealable vents can be disposed on the outer hull, or on the top surface.

Embodiments can also comprise a rigid outer hull having a substantially circular shape in plan view and a rounded bottom surface for contacting a body of liquid, and a rigid top surface disposed opposite the bottom surface and integrally formed with the outer hull. The top surface can include an annular stability portion having convex walls in cross-section and a recessed flat-bottomed deck portion adapted to receive a person, and the recessed deck portion can comprise a plurality of arcuately-shaped concavities disposed in a side wall of the recessed deck portion and constructed to contour a knee or foot of the person so as to allow for use of the watercraft in a seated or kneeling position. In such embodiments, the plurality of arcuately-shaped concavities can comprise four concavities arranged to form a clover shape in plan view.

Furthermore, in such embodiments, an edge of the recessed deck portion can be disposed inwardly from an outermost edge of the top portion by a distance equal to at least one-fourth of a radial distance from the outermost edge to a center of the top surface in plan view.

Embodiments can also comprise a method of movement upon a surface of a body of liquid, by providing a watercraft as described above, and paddling the liquid using a sculling motion to propel the watercraft laterally across a surface of the liquid or paddling the liquid in a stroking manner to cause rotation of the watercraft upon the surface of the liquid. Such methods can also include expelling air from an interior cavity portion of the watercraft formed by the outer hull and the top surface via one or more sealable vents provided in communication with the interior cavity portion. The expelling air is actuated by compression of the top surface with respect to the outer hull in response to weight being applied to top surface.

BRIEF DESCRIPTION OF THE DRAWINGS

Embodiments will hereinafter be described in detail below with reference to the accompanying drawings, wherein like reference numerals represent like elements.

DETAILED DESCRIPTION

Embodiments relate generally to a watercraft and related methods.

Figure 1:
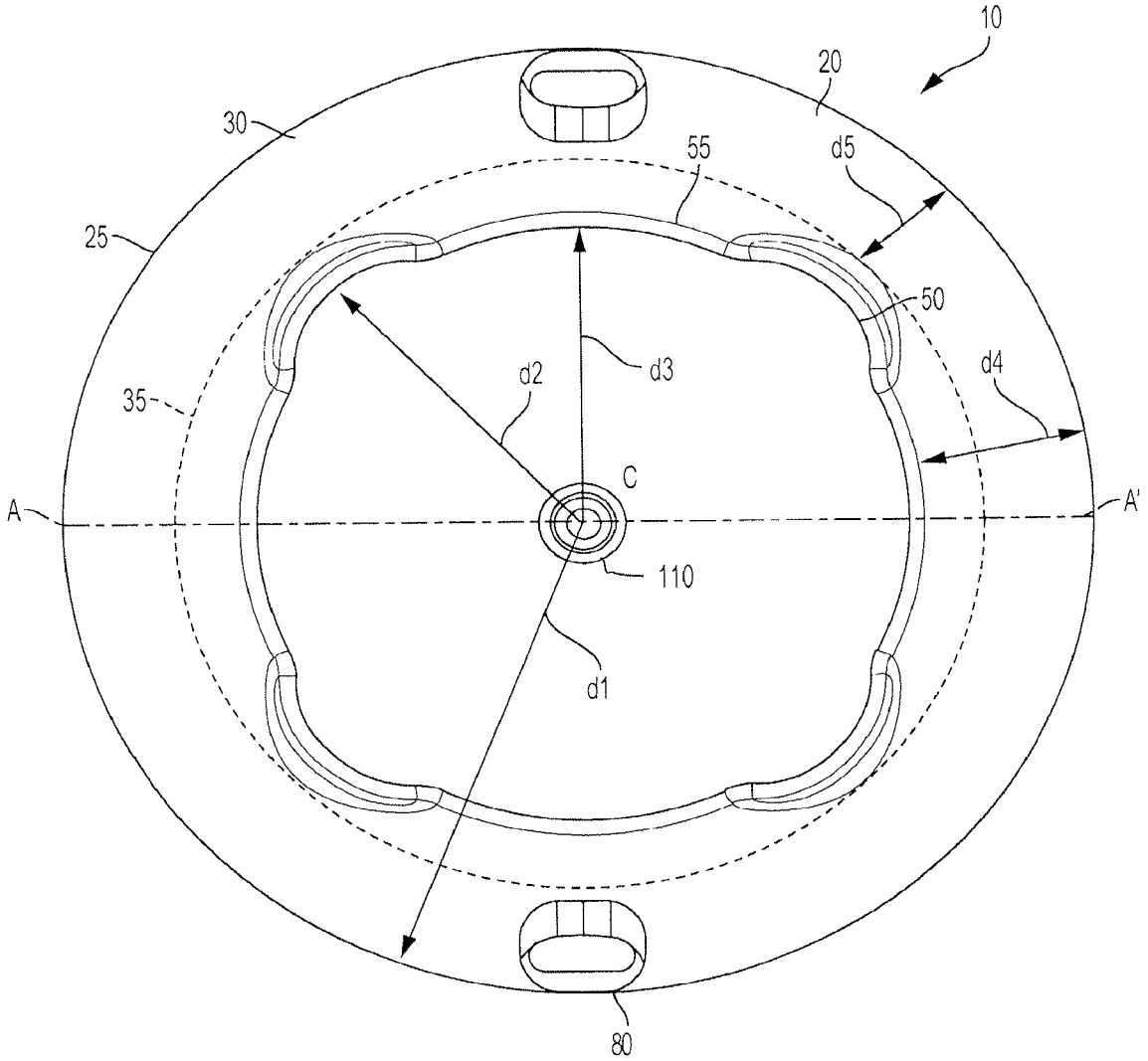
FIG. 1 is a top plan view of a watercraft in accordance with various embodiments.

With respect to FIG. 1, there is shown a plan view of a watercraft 10 in accordance with various embodiments. Referring now to FIG. 1, the watercraft 10 comprises a rigid outer hull 20 having a substantially circular or round shape in plan view and including a rigid top surface 30. In at least one embodiment, the watercraft 10 is formed to have a double-hull including the rigid outer hull 20 and an inner hull integrally formed therewith. In some embodiments, the integrally-formed double hull can be made of polyethylene using rotational molding, thermoforming, or blowmolding processes. However, other materials are possible, for example, fiberglass and foam or an inflatable rigid material may be used, a combination thereof.

Figure 2:
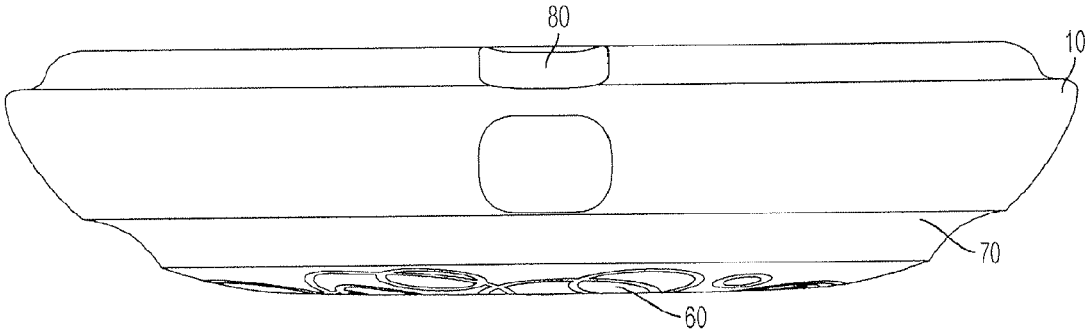
FIG. 2 is a side view of the watercraft in accordance with various embodiments.

With respect to FIG. 2, there is shown a side view of the watercraft 10 in accordance with various embodiments. Referring now to FIG. 2, the outer hull 20 can include a rounded bottom surface 60 for contacting a body of liquid. The rigid top surface 30 is disposed opposite a bottom surface 60. The entire outer hull 20 including the top surface 30 and the bottom surface 60 are integrally formed.

Figure 3A:
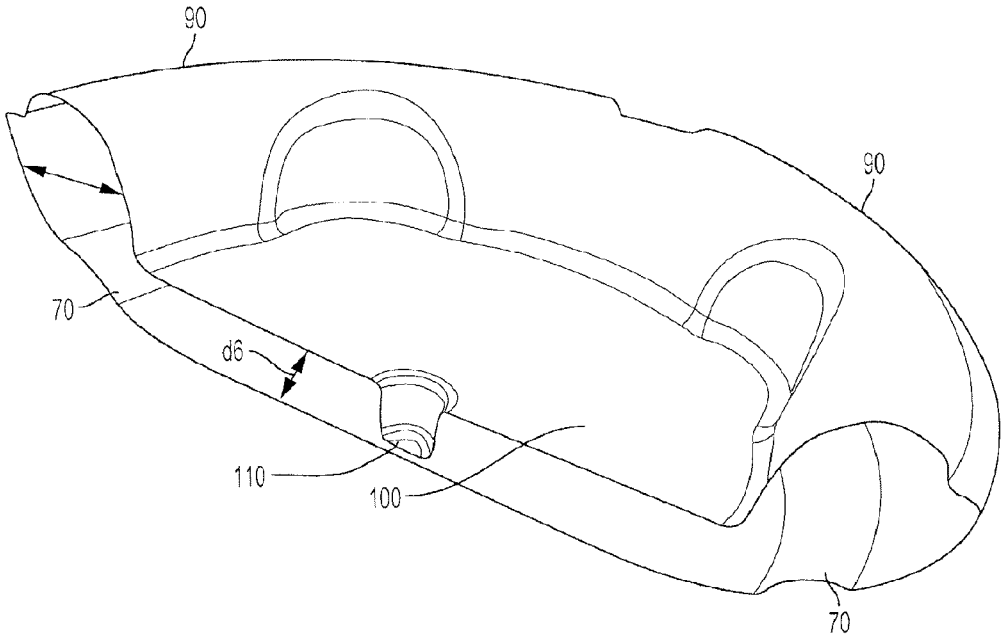
FIGS. 3A and 3B are a cross-section view of the watercraft taken along the line A-A' in FIG. 1 in accordance with various embodiments.
Figure 3B:
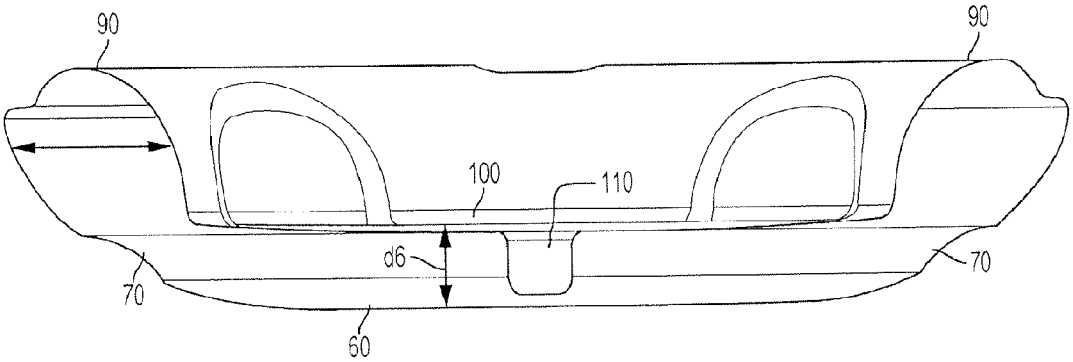

With respect to FIGS. 3A and 3B, there is shown a cross-section view of the watercraft 10 taken along the line A-A' of FIG. 1 in accordance with various embodiments. Referring now to FIGS. 3A and 3B, the top surface 30 can be an annular, convex-shaped stability portion 90 having a convex shape in cross-section, and a recessed flat-bottomed deck portion 100 of the inner hull which is adapted to receive a person (e.g., a user). Furthermore, embodiments can include one or more cup-shaped depressions 110 in the recessed deck portion 100. In at least one embodiment, one such cup-shaped depression 110 can be disposed in the middle of the recessed deck portion 100. In at least one embodiment, the cup-shaped depression 110 is a bump-off associated with a rotational molding process of forming the watercraft 10. In various embodiments, the cup-shaped depression 110 adds strength to the flat deck area 100 by breaking it up, and controls deck flex by allowing the deck 100 to flex through a small range of motion until the cup-shaped depression 110 'bumps' off the inside surface of the bottom hull which reduces strain on the deck thus operates to prevent the deck or the sides from changing shape and/or elastically deforming.

Referring again to FIG. 1, the recessed deck portion 100 can include a plurality of arcuately-shaped concavities 50 disposed in a side wall 55 of the recessed deck portion 100 and constructed to contour a knee or foot of the person so as to allow for use of the watercraft in a kneeling position or a cross-legged sitting position. In at least one embodiment, the plurality of arcuately-shaped concavities comprises four concavities arranged to form a clover shape in plan view. Such embodiments provide a dual advantage of providing space for feet within the concavity when seated and space for knees when a user is kneeling and wants to be closer to the outer edge, while also adding to the rigidity and strength of the inside walls of the watercraft 10.

Furthermore, in at least one embodiment, an edge of the recessed deck portion 100 at one of the concavities 50 is disposed inwardly from an outermost edge 25 of the top portion 30 by a distance (d5) equal to at least one-fourth of a radial distance (d1) from said outermost edge 25 to a center (C) of the top surface 30 in plan view. In at least one embodiment, an edge of the recessed deck portion 100 at an edge of the side wall 50 at a location other than one of the concavities 50 is disposed inwardly from an outermost edge 25 of the top portion 30 by a distance (d4) equal to at least one-third of the radial distance (d1) from said outermost edge 25 to a center (C) of the top surface 30 in plan view. Furthermore, in at least one embodiment, a radial distance (d2) from the centerpoint of one of the concavities 50 to the center (C) of the top surface 30 is longer than a radial distance (d3) from the edge of the side wall 55 to the center (C) of the top surface 30. In various embodiments, the overall diameter of the watercraft is substantially 47 inches or less. Other embodiments are possible, however, such as larger diameter embodiments to more easily accommodate multiple users. The distance between consecutive concavities along the side wall 55 can be, for example, from 7-14 inches, in various embodiments.

The present inventors have determined that such an arrangement is effective to provide increased stability when the watercraft 10 is deployed in a body of liquid such as a lake, stream, river, pool, or other such body of water or liquid, thus preventing unwanted capsizing or tipping over onto the user, than can occur with conventional articles. In particular, such an arrangement ensures that a sufficient volume of gas such as air or foam is enclosed in an interior region formed by the outer hull 20, the recessed deck portion 100, and the annular, convex-shaped stability portion 90, to provide buoyancy and to prevent fast tipping over or capsizing of the watercraft 10. Furthermore, if the watercraft 10 does flip, it does so gradually and predictably. The degree of flatness of the bottom of outer hull 10, and the amount of air contained in the trapped area defined by the sides of the watercraft 10 obtained by providing convex top surface walls in cross-section (as opposed to straight or concave) provides particular stability when operating the watercraft in water. With convex interior walls leading down to the recessed deck portion, a significant volume of air pushes back against the weight of the users when they lean into the edge. The convex exterior walls also operate to cause the user's body weight to be closer to center of the watercraft. These features also make capsizing more difficult, as the stability of the watercraft is increased by forcing the user/operator towards the center of the boat. Keeping the user towards the center and not on the edge also lowers their center of gravity and keeps the watercraft more stable. If the user does flip the watercraft, the convex interior walls forcing user center positioning allows the body to move roughly at the same speed as the watercraft and an overall slowing of the tipping event.

The above-described dimensions of the watercraft 10 also allow it to be easily propelled by a user with a relatively small paddle such as a kayak paddle, which is easier to manipulate while propelling the watercraft 10 forward and also allows the user to spin the watercraft 10 more quickly. For example, the overall diameter of the watercraft 10 is such that smaller users can propel the watercraft 10 using a kayak paddle without bumping against the edges of the watercraft on each stroke. The diameter also allows for a relatively steep water entry angle for the paddle blade and, therefore, a stronger stroke and easier straightline tracking.

Figure 4:
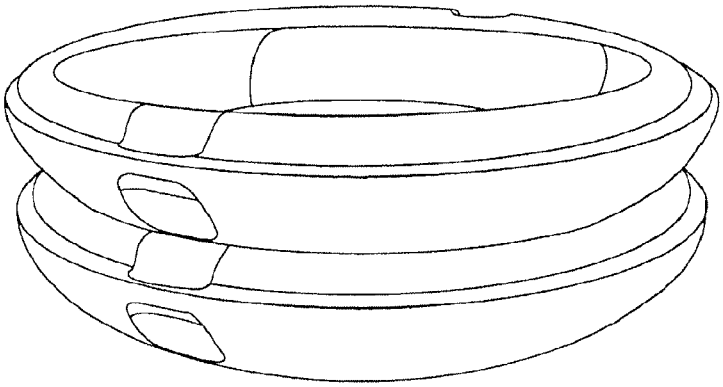
FIG. 4 illustrates two interlocking stacked watercraft in accordance with various embodiments.
Figure 5:
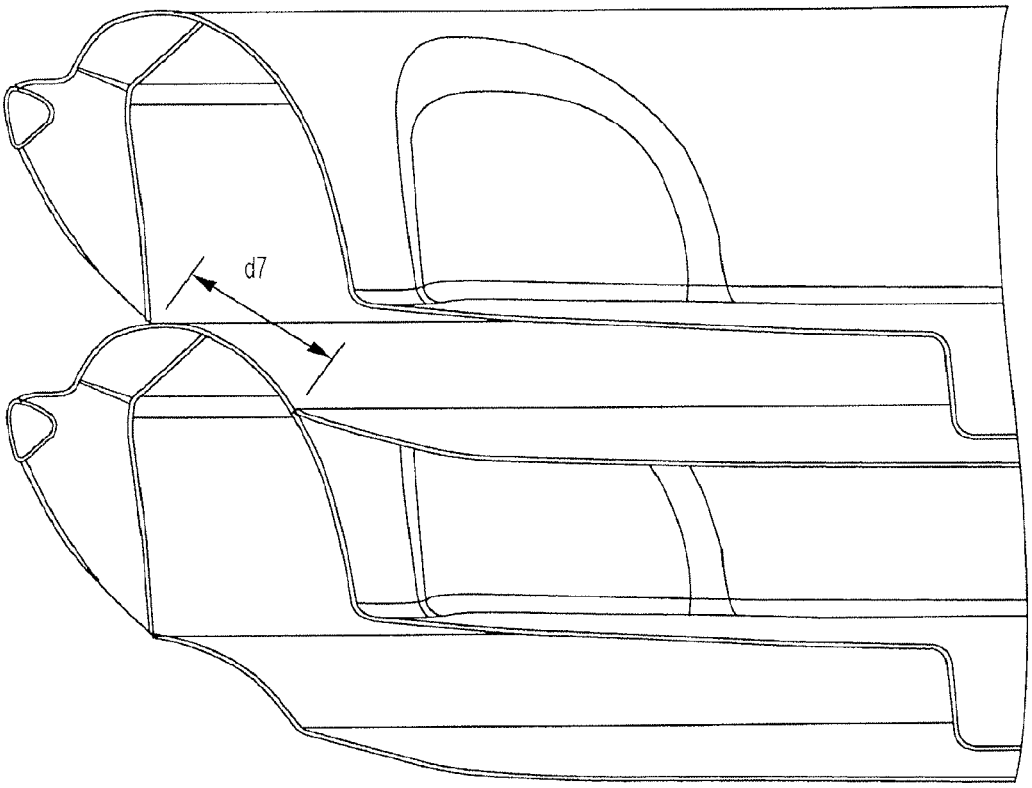
FIG. 5 is a cross-section view of the interlocking stacked watercraft of FIG. 4 in accordance with various embodiments.

Referring again to FIG. 1, the outer hull 20 may further include a plurality of scalloped handle portions 80 disposed on opposite sides of the outer hull 20, and a 360-degree perimeter rib 70 which annularly surrounds a lower portion of said outer hull and has a concave shape in cross-section view. As shown in FIGS. 4 and 5, in various embodiments, the 360-degree perimeter rib are constructed such that the perimeter rib 70 of one watercraft 10 fits with corresponding portions of a second watercraft 10 upon which the first watercraft 10 is stacked. The interlocking of stacked perimeter rib allows for several watercraft to be stacked for efficient, space-conserving storage and stable transportation, such as on a pallet. For example, as shown in FIG. 5, the 360-degree perimeter rib 70 of one watercraft 10 engages with corresponding portions of a second watercraft 10 upon which the first watercraft 10 is stacked by a distance 'd7' in cross-section. Furthermore, the particular dimensions as discussed hereinabove allows for storage and shipment on a standard 48×48 pallet and also shipment via a parcel post carrier (e.g., FedEx or UPS). In addition, the 360-degree perimeter rib 70 adds to the structural rigidity of the hull and prevents buckling under heavy weight.

In some embodiments, the watercraft 10 can include an interior cavity portion or void formed by the outer hull 20, the recessed deck portion 100, and the annular, convex-shaped stability portion 90. In such embodiments, the outer hull 20 can further include one or more sealable vents (which may also act as drain plugs) for venting air contained within the interior cavity portion formed by the outer hull 20, the recessed deck portion 100, and the annular, convex-shaped stability portion 90. In at least one embodiment, two such sealable vents can be provided. The sealable vent or vents can be located proximate to the handle portions 80 on the outer hull 20 or on the top surface, and is/are provided in communication with the interior cavity portion. When the top surface is compressed with respect to the outer hull 20 in response to weight being applied to the top surface (see distance 'd6' in FIGS. 3A and 3B), the decreased volume of the interior cavity portion causes air to be expelled from the interior cavity portion via the sealable vents provided in communication with the cavity portion. For example, if a person boards the watercraft 10 deployed in liquid, and then opens the sealable vent(s), the top surface of the watercraft 10 is compressed and moves toward the outer hull 20, thus causing a decrease in volume of the interior cavity. The amount of air expelled varies with the weight (of the person or user) applied to the top surface. The decreased amount of air contained in the interior cavity due to the optional venting causes decreased buoyancy, thus causing the watercraft 10 to ride lower in the water or liquid, which further enhances stability and prevents unwanted capsizing. The cup-shaped depression 110 can also help control the maximum of venting allowed, as once the cup impacts the bottom hull, the maximum air release has been achieved.

In various embodiments, the sealable vent(s) can be positioned on the outer hull 20 at an inclined, outward facing flat area to allow a vent plug to enter the mold at an angle and be positioned further from either side internally. This allows for the sealable vent to function efficiently and reduces the impact of internal air turbulence in the area where the two mold halves meet at the handle during manufacturing. The vent plug(s) are disposed at an outside edge of the watercraft 10, away from the user and paddle handle impact. This also makes it more comfortable for user to carry the watercraft 10.

In other embodiments, foam may instead be contained within the interior cavity portion formed by the the outer hull 20, the recessed deck portion 100, and the annular, convex-shaped stability portion 90, in which embodiments do not include the sealable vent(s).

Figure 6:
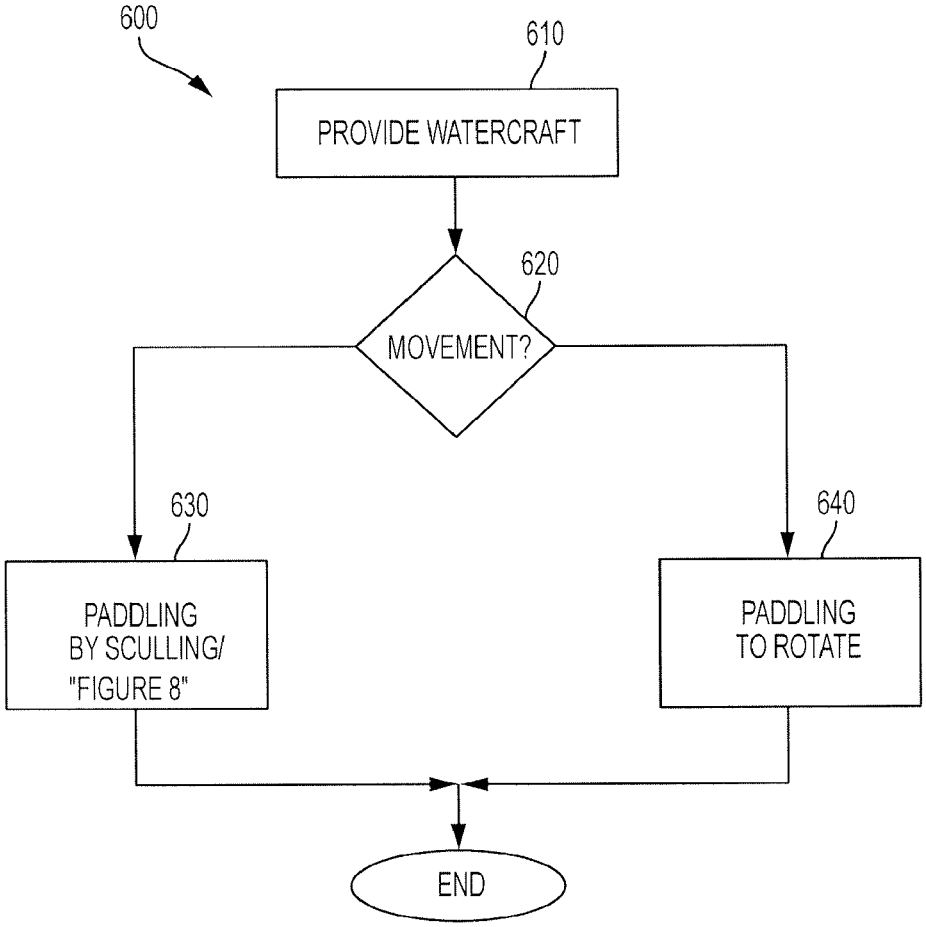
FIG. 6 is flowchart of a method of using the watercraft according to various embodiments.

With respect to FIG. 6, there is shown a method 600 of movement upon a surface of a body of liquid. Referring now to FIG. 6, the method 600 can comprise providing a watercraft as described hereinabove (block 610), and then choosing a motion for traversing or rotating in the body of water/liquid using the watercraft 10 (block 620) such as, for example: paddling the liquid using a sculling motion or figure-8 pattern to propel the watercraft laterally across a surface of the liquid (block 630), or paddling the liquid in a stroking manner to cause rotation of the watercraft upon the surface of the liquid (block 640).

Figure 7A:
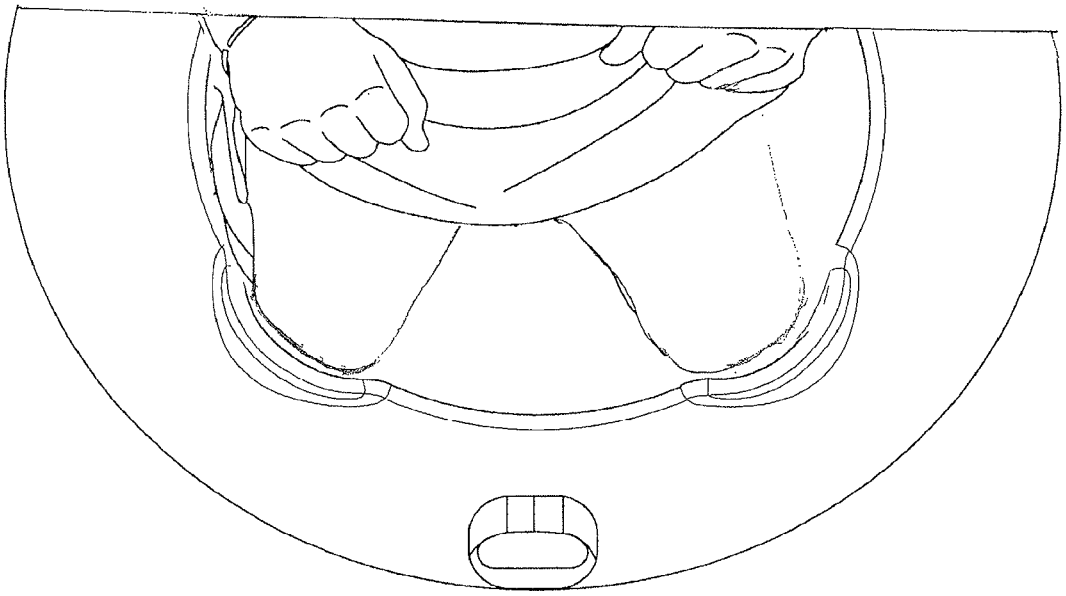
FIG. 7A illustrates a kneeling method associated with various embodiments.
Figure 7B:
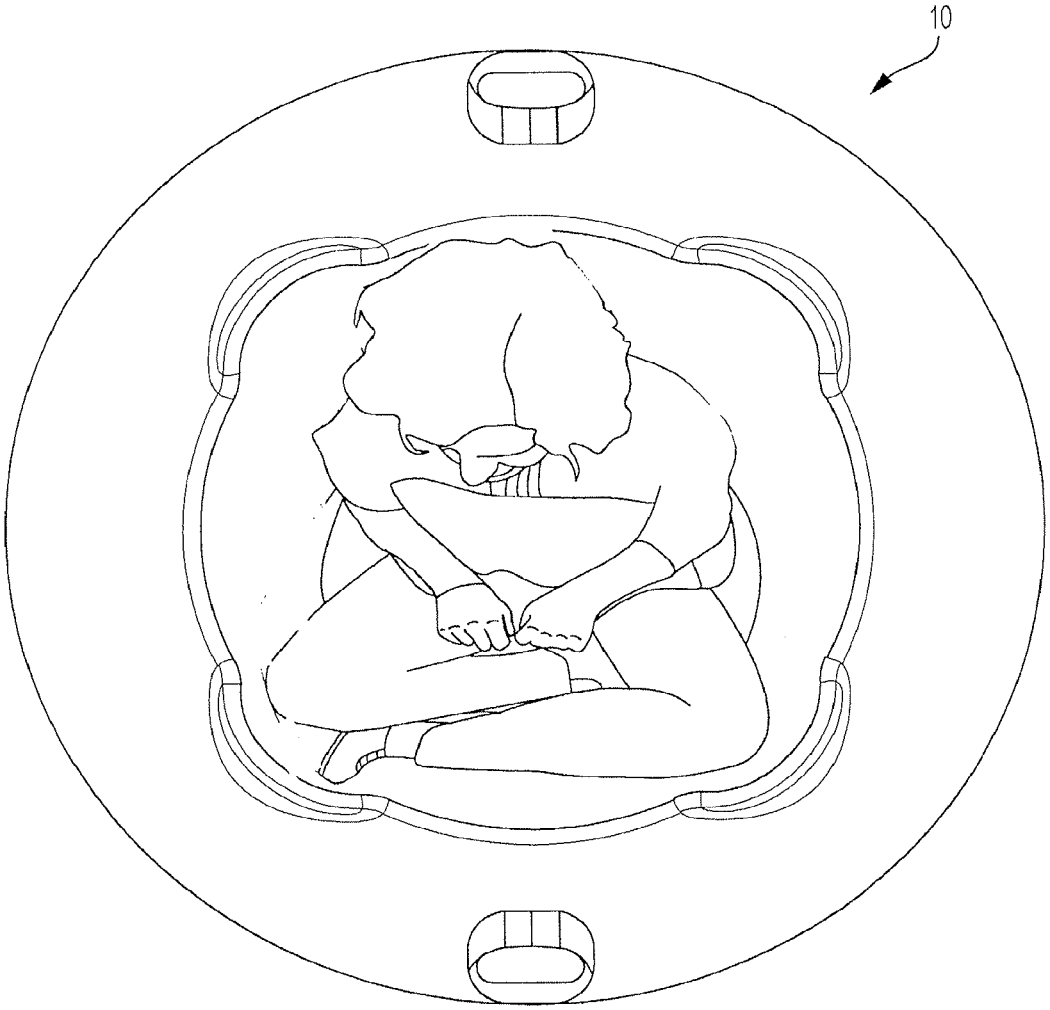
FIG. 7B illustrates a seated method associated with various embodiments.
Figure 7C:
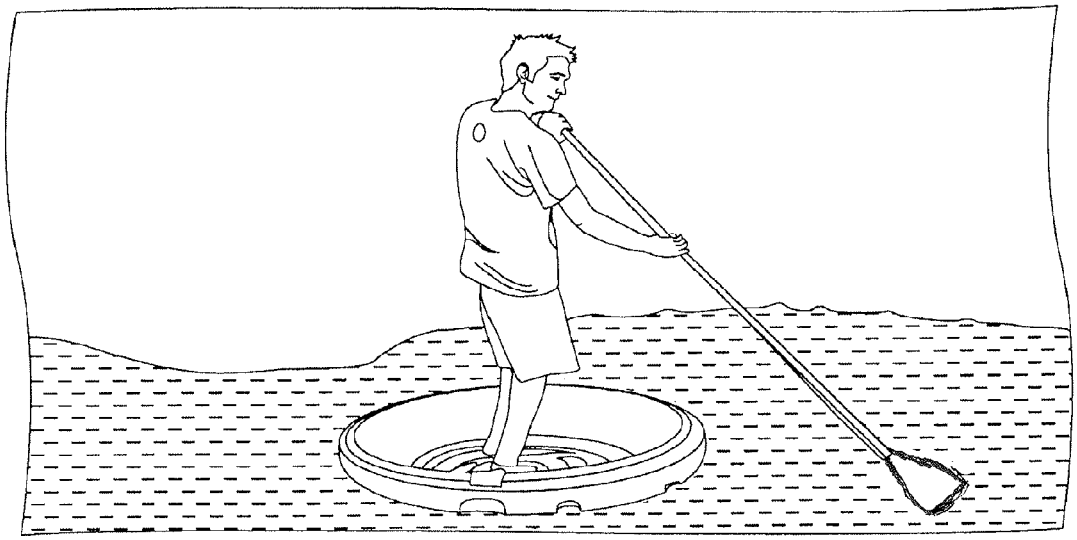
FIG. 7C illustrates a standing method associated with various embodiments.

Furthermore, the watercraft 10 can be operated in at least kneeling, cross-legged seated, or standing positions. For example, FIG. 7A illustrates a kneeling method associated with various embodiments. In a preferred kneeling method, the user's knees are disposed in close abutment with two concavities 50, such that the user's body is wedged tightly against the inner surface of the two concavities 50 for bracing. FIG. 7B illustrates a seated method associated with various embodiments; and FIG. 7C illustrates a standing method associated with various embodiments. While standing, a larger user can contact two of the concavities 50 with the user's feet for bracing.

Thus, embodiments allow for new and useful movements such as paddling while kneeling or standing. The round shape of the watercraft 10 allows its user to kneel and stand and with a sculling motion of the paddle (canoe or SUP, respectively) to traverse the liquid in a forward or straight direction forward. Furthermore, the watercraft 10 can also be used as a spinning toy—the round shape allows its user to spin and change direction efficiently—fastest with a kayak paddle, but any paddle will work. The watercraft 10 can also be used as an exercise device. The particular shape of the watercraft 10 according to various embodiments, being not just round in shape, but also have a particular angle of hull and sides, allows its user to exercise uniquely by working balance, stamina, hamstrings, glutes, abdomen, entire leg and arms due to the additional presence of torque or angular momentum caused by the rotational movement of the watercraft 10. Thus, users can achieve functional training of abdominals, thighs, back musculature and balance through up to 360-degree rotational and lateral movement and response while sitting, kneeling or standing using the watercraft 10.

The method 600 can further comprise expelling air from an interior cavity portion of the watercraft formed by the outer hull and the recessed deck portion and/or top surface via one or more sealable vents provided in communication with the interior cavity portion. The expelling of air can be actuated by compression of the top surface or deck portion with respect to the outer hull in response to weight being applied to top surface, such as occurs when a person boards the watercraft and opens one or more of the sealable vents, and then closes the sealable vent(s) after the air has been expelled.

Thus has been shown a watercraft and methods for using the same. While the invention has been described in conjunction with a number of embodiments, it is evident that many alternatives, modifications and variations would be or are apparent to those of ordinary skill in the applicable arts. Accordingly, Applicant intends to embrace all such alternatives, modifications, equivalents and variations that are within the spirit and scope of the invention.

What is claimed is:

1. A watercraft comprising:

a rigid outer hull having a round shape in plan view and a bottom surface for contacting a body of liquid; and a rigid top surface disposed opposite said bottom surface and integrally formed with said outer hull, wherein said top surface comprises an annular stability portion having convex walls in cross-section and a recessed flat-bottomed deck portion adapted to receive a person, and wherein an edge of said recessed deck portion is disposed inwardly from an outermost edge of said outer hull by a distance as measured from said outermost edge to a center of the top surface in plan view.

2. The watercraft according to claim 1, wherein said recessed deck portion comprises a plurality of arcuately-shaped concavities disposed in a side wall of said recessed deck portion and each constructed to contour a knee of a person so as to allow for use of the watercraft with the person's knees each in abutment with an interior surface of one of said arcuately-shaped concavities in a seated or kneeling position, or with the person's feet each in abutment with the interior surface of one of said arcuately-shaped concavities.

3. The watercraft according to claim 2, wherein the plurality of arcuately-shaped concavities comprises four concavities arranged to form a clover shape in plan view each spaced from 7 to 14 inches from each other.

4. The watercraft according to claim 1, wherein said outer hull further comprises:

a plurality of scalloped handle portions disposed on opposite sides of said outer hull; and a 360-degree perimeter rib disposed annularly surrounding a lower portion of said outer hull and having a concave shape in cross-section view, wherein said 360-degree perimeter rib is constructed such that said 360-degree perimeter rib of a first one of said watercraft cooperates to fittingly engage corresponding portions of a second one of watercraft upon which said first watercraft is stacked to provide for stable transportation or vertical storage of a plurality of said watercraft.

5. The watercraft of claim 1, further comprising:

one or more sealable vents for venting air contained within an interior cavity portion formed by said outer hull and said top surface.

6. A method of movement upon a surface of a body of liquid, comprising:

providing a watercraft comprising a rigid outer hull having a round shape in plan view and a bottom surface for contacting a body of liquid, and a rigid top surface disposed opposite said bottom surface and integrally formed with said outer hull, wherein said top surface comprises an annular stability portion having convex walls in cross-section and a recessed flat-bottomed deck portion adapted to receive a person, wherein said recessed deck portion comprises a plurality of arcuately-shaped concavities disposed in a side wall of said recessed deck portion and each constructed to contour a knee or foot of the person so as to allow for use of the watercraft in a seated or kneeling position, and wherein an edge of said recessed deck portion is disposed inwardly from an outermost edge of said top portion by a distance as measured from said outermost edge to a center of the top surface in plan view; and paddling said liquid using a sculling motion to propel said watercraft laterally across a surface of said liquid or paddling said liquid in a stroking manner to cause rotation of said watercraft upon the surface of said liquid.

7. The method of claim 6, further comprising:

decreasing buoyancy by expelling air from an interior cavity portion of said watercraft formed by said outer hull and said top surface via one or more sealable vents provided in communication with said interior cavity portion.

8. The method of claim 7, wherein said expelling air is actuated by compression of the top surface with respect to said outer hull in response to weight being applied to top surface, and wherein said compression is limited by a cup-shaped depression disposed in said recessed deck portion.

9. The method of claim 6, wherein a radial distance from a centerpoint of one of said plurality of concavities to the center of said top surface is longer than a radial distance from an edge of the side wall of the recessed portion to the center of said top surface.

10. The watercraft according to claim 1, wherein a radial distance from a centerpoint of one of said plurality of concavities to the center of said top surface is longer than a radial distance from an edge of the side wall of the recessed portion to the center of said top surface.

11. The watercraft according to claim 1, further comprising a cup-shaped depression disposed in said recessed deck portion.

12. The watercraft according to claim 1, further comprising a foam-filled cavity portion defined by said rigid outer hull and said bottom surface.

13. A watercraft comprising:

a rigid outer hull having a round shape in plan view and a bottom surface for contacting a body of liquid; and a rigid top surface disposed opposite said bottom surface and integrally formed with said outer hull, wherein said top surface comprises an annular stability portion having at least one wall portion which is convex in cross-section and a recessed deck capable of supporting a person, and wherein an edge of said recessed deck is disposed inwardly from an outermost edge of said outer hull.

14. The watercraft according to claim 13, wherein said recessed deck comprises a plurality of arcuately-shaped concavities disposed in a side wall of said recessed deck and each constructed to contour a knee of a person so as to allow for use of the watercraft with the person's knees each in abutment with an interior surface of one of said arcuately-shaped concavities in a seated or kneeling position, or with the person's feet each in abutment with the interior surface of one of said arcuately-shaped concavities.

15. The watercraft according to claim 14, wherein the plurality of arcuately-shaped concavities comprises four concavities arranged to form a clover shape in plan view.

16. The watercraft according to claim 13, wherein said outer hull further comprises:

a plurality of scalloped handle portions disposed on opposite sides of said outer hull; and a 360-degree perimeter rib disposed annularly surrounding a lower portion of said outer hull and having a concave shape in cross-section view, wherein said 360-degree perimeter rib is constructed such that said 360-degree perimeter rib of a first one of said watercraft cooperates to fittingly engage corresponding portions of a second one of watercraft upon which said first watercraft is stacked to provide for stable transportation or vertical storage of a plurality of said watercraft.

17. The watercraft of claim 13, further comprising:

one or more sealable vents for venting air contained within an interior cavity portion formed by said outer hull and said top surface.

18. The watercraft of claim 13, further comprising:

a cup-shaped depression disposed in said recessed deck operable to limit compression of the top surface with respect to said outer hull in response to weight being applied to top surface.

19. The watercraft of claim 13, wherein the annular stability portion is constructed to maintain a user's center of gravity toward a center of the watercraft.

20. The watercraft of claim 1, wherein the annular stability portion is constructed to maintain a user's center of gravity toward a center of the watercraft.

* * * * *